US008789683B2

(12) United States Patent
Gadliger

(10) Patent No.: US 8,789,683 B2
(45) Date of Patent: Jul. 29, 2014

(54) CROSSING BETWEEN TWO TRANSPORT LINES CONFIGURED FOR THE HORIZONTAL TRANSPORT OF PLANAR ARTICLES

(75) Inventor: Urs Gadliger, Trachslau (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 13/446,934

(22) Filed: Apr. 13, 2012

(65) Prior Publication Data

US 2012/0298484 A1 Nov. 29, 2012

(30) Foreign Application Priority Data

Apr. 14, 2011 (CH) ..... 671/11

(51) Int. Cl.
*B65G 43/10* (2006.01)

(52) U.S. Cl.
USPC .. 198/575; 198/457.07; 198/598; 198/370.08

(58) Field of Classification Search
USPC ..... 198/575, 584, 587, 589, 598, 630, 198/860.1, 373, 570, 580, 591
See application file for complete search history.

(56) References Cited

U.S. PATENT DOCUMENTS

| | | | | |
|---|---|---|---|---|
| 3,467,238 | A * | 9/1969 | Fry et al. | 198/370.1 |
| 4,424,966 | A | 1/1984 | Chandhoke | |
| 4,494,705 | A | 1/1985 | Linder | |
| 4,541,824 | A | 9/1985 | Müller | |
| 4,580,739 | A | 4/1986 | Linder | |
| 4,848,558 | A * | 7/1989 | Rechsteiner | 198/369.2 |
| 4,860,880 | A * | 8/1989 | Hinchcliffe et al. | 198/405 |
| 6,390,278 | B1 * | 5/2002 | Brown | 198/463.3 |
| 2009/0319086 | A1 * | 12/2009 | Kramer | 700/275 |
| 2011/0100786 | A1 * | 5/2011 | Glisch et al. | 198/860.1 |

FOREIGN PATENT DOCUMENTS

| | | | |
|---|---|---|---|
| CH | 700 152 | A1 | 6/2010 |
| DE | 33 04219 | A1 | 10/1983 |
| DE | 33 02 935 | A1 | 7/1984 |
| EP | 0 478 911 | A1 | 4/1992 |
| EP | 1 475 329 | A1 | 11/2004 |
| EP | 1 900 666 | A1 | 3/2008 |
| EP | 2 107 023 | A1 | 10/2009 |
| WO | WO94/02398 | | 2/1994 |
| WO | WO 2010/006437 | A1 | 1/2010 |

* cited by examiner

*Primary Examiner* — Ramya Burgess
*Assistant Examiner* — Lester Rushin
(74) *Attorney, Agent, or Firm* — Pauley Petersen & Erickson

(57) ABSTRACT

A crossing between two transport lines is configured for the horizontal transport of planar articles, preferably in the form of an imbricated stream, of which one transport line is led away at a crossing over the other transport line. Controllable means for transferring the transported articles from one of the transport lines to the other are provided, which, in a first setting, freely admit the transport of the articles on one of the transport lines and, in a second setting, divert the transported articles from one of the transport lines to the other. A transfer apparatus may include a flexible diversion line, which describes a space curve and which with a movable free end, in the first setting, maintains a distance to one of the transport lines and, in the second setting, engages with the free end in one of the transport lines to effect a diversion.

12 Claims, 4 Drawing Sheets

CROSSING BETWEEN TWO TRANSPORT LINES CONFIGURED FOR THE HORIZONTAL TRANSPORT OF PLANAR ARTICLES

CROSS REFERENCE TO RELATED APPLICATION

Swiss Patent Reference 00671/11, filed 14 Apr. 2011, the priority document corresponding to this invention, and its teachings are incorporated, by reference, into this specification.

BACKGROUND OF THE INVENTION

1. Field of the Invention

The present invention relates to the field of transport technology, as is used, in particular, within print finishing. It relates to a crossing between two transport lines, according to the preamble to claim 1.

2. Discussion of Related Art

In print finishing, also know as print further processing, but not just in this sphere, planar articles, for example folded printed sheets, newspapers, brochures, flyers or the like, are frequently transported in compressed form as an imbricated stream between the various treatment and/or storage stations. It is here often necessary to divert imbricated streams from one transport line to another, intersecting transport line, this diversion being intended to be realized by switchable means. In a first setting, the articles are forwarded on one transport line without further obstacle. In a switchable second setting, the imbricated stream is diverted from one transport line to the intersecting other transport line. The imbricated stream formation as such is here intended to remain as far as possible unchanged.

Printed publication DE 33 02 935 discloses an apparatus for turning partial imbricated streams of given length, consisting of printed sheets or the like, about their vertical centre axis, in which printed sheets in the form of an imbricated stream are directed via a right-angled diverter to a points switch, and from this onto a winding station belt. The printed sheets are spooled with a winding tape onto a core to form a reel and are temporarily stored in this form. If the printed sheets are to be fed to the finishing facility, then the winding tape is unrolled from the reel and rolled back on from a tape supply roll. As the winding tape is unrolled from the reel, a points switch is pivoted into a lower position, whereby the printed sheets make their way onto a lower, right-angled diverter, and from this onto a part of a conveying line (see FIGS. 1 and 2 of this publication). The diversion between the individual lines is here realized by fixed 90° deflectors, the free ends of which are arranged one above the other and can be freely selected by a points switch.

Printed publication DE 33 04 219 discloses an apparatus for stacking printed sheets, having a hub rotatably mounted in a machine stand, having a tape which is led up to the hub along a predefined path and can be spooled onto or Unspooled from this, a first transfer point being provided on the path of the tape. The tape is guided over a plurality of diverting rollers and can selectively be spooled on one of two hubs and forms on its path a first transfer point and a second transfer point. A points switch arrangement connects, on the one hand, the second transfer point to a feeder conveying line and to the first transfer point. It further connects the first transfer point to an evacuation line. The points switch arrangement has a fixedly mounted conveyor belt, which can be driven in two directions, as well as two parallel conveyor belts, whose ends facing one conveyor belt can be swung up and down. If, on the feeder conveyor line, a multiplicity of printed sheets which are joined together into a partial imbricated stream are advanced and the printed sheets are ejected from there onto one conveyor belt, then these printed sheets, once again in the form of a partial imbricated stream, are transferred from the lowered end of the conveyor belt onto the other conveyor belt, and from there onto a further belt (see FIGS. 1-3). In this case, too, the switchable diversion is effected solely by pivotable switch points.

The same also applies to the device for processing print products according to printed publication WO 94/02398.

In all cases known from the prior art, actively driven points switches are used to achieve switchability, whereby a more complex drive mechanism and control system is demanded. Moreover, the imbricated stream formation is frequently changed or influenced.

SUMMARY OF THE INVENTION

One object of the invention is therefore to configure a crossing of the generic type such that these drawbacks are avoided and that, in particular, a simplified switchover is possible.

These and other objects are achieved by the features of claim 1.

The invention is based on a crossing between two transport lines configured for the horizontal transport of planar articles, in particular print products, preferably in the form of an imbricated stream, of which one transport line is led away over the other transport line at a predefined distance apart and angle, wherein, in the region of the crossing, controllable means for transferring the transported articles from one of the transport lines to the other of the transport lines are provided, which controllable means, in a first setting, freely admit the transport of the articles on one of the transport lines and, in a second setting, divert the transported articles from one of the transport lines to the other. It is characterized in that the transfer means comprise a transfer apparatus having an adaptable diversion line, which describes a space curve and which with a movable free end, in the first setting, maintains a distance to one of the transport lines and, in the second setting, engages with the free end in one of the transport lines to effect a diversion.

One embodiment of the invention is distinguished by the fact that the other end of the diversion line is transport-connected to the other of the transport lines. This allows the adjustment mechanism to be simplified further.

The mechanism becomes particularly simple if, according to another embodiment, the diversion line has a constant length and, upon movement of the free end of the diversion line, the space curve of the diversion line changes. By movement is here understood, inter alia, a displacement and also a pivoting.

A further embodiment of the invention is characterized in that the diversion line has at least one supporting strip which tracks the space curve and on which the articles transported on the diversion line are guided in recumbent arrangement.

The supporting strip can consist of various materials, for example a plastic. In particular, the at least one supporting strip can be a metal or sheet-metal strip, which is particularly resistant during operation and, in combination with simultaneously high stability, adapts well to the space curve.

For the support of the articles, it is particularly advantageous if two mutually parallel running, spaced-apart supporting strips are provided, and a roller conveyer, tracking the space curve, is arranged between the supporting strips.

In particular, for the transport of the articles along the roller conveyor, a driven lower belt resting on the roller conveyor is provided.

For the fixing of the articles on the lower belt, an adjacent upper belt, which is passively moved together with the lower belt, is provided.

Another embodiment of the invention is distinguished by the fact that in one of the transport lines is provided a swing-out line portion, and that on the movable free end of the diversion line is arranged an actuating means, with which the diversion line, upon engagement in one of the transport lines, pivots the swing-out line portion out of one of the transport lines.

Preferably, for the movement of the free end of the diversion line, an adjusting apparatus is provided.

The adjusting apparatus advantageously works pneumatically or hydraulically or electrically.

Another embodiment is characterized in that the two transport lines intersect at an angle of substantially 90°, and in that the diversion line describes a space curve, which effects a diversion of substantially 90°, with simultaneous turning of the planar articles.

BRIEF DESCRIPTION OF THE DRAWINGS

The invention shall be described in greater detail below with reference to illustrative embodiments in association with the drawing, wherein.

DESCRIPTION OF PREFERRED EMBODIMENTS

Figure 1:
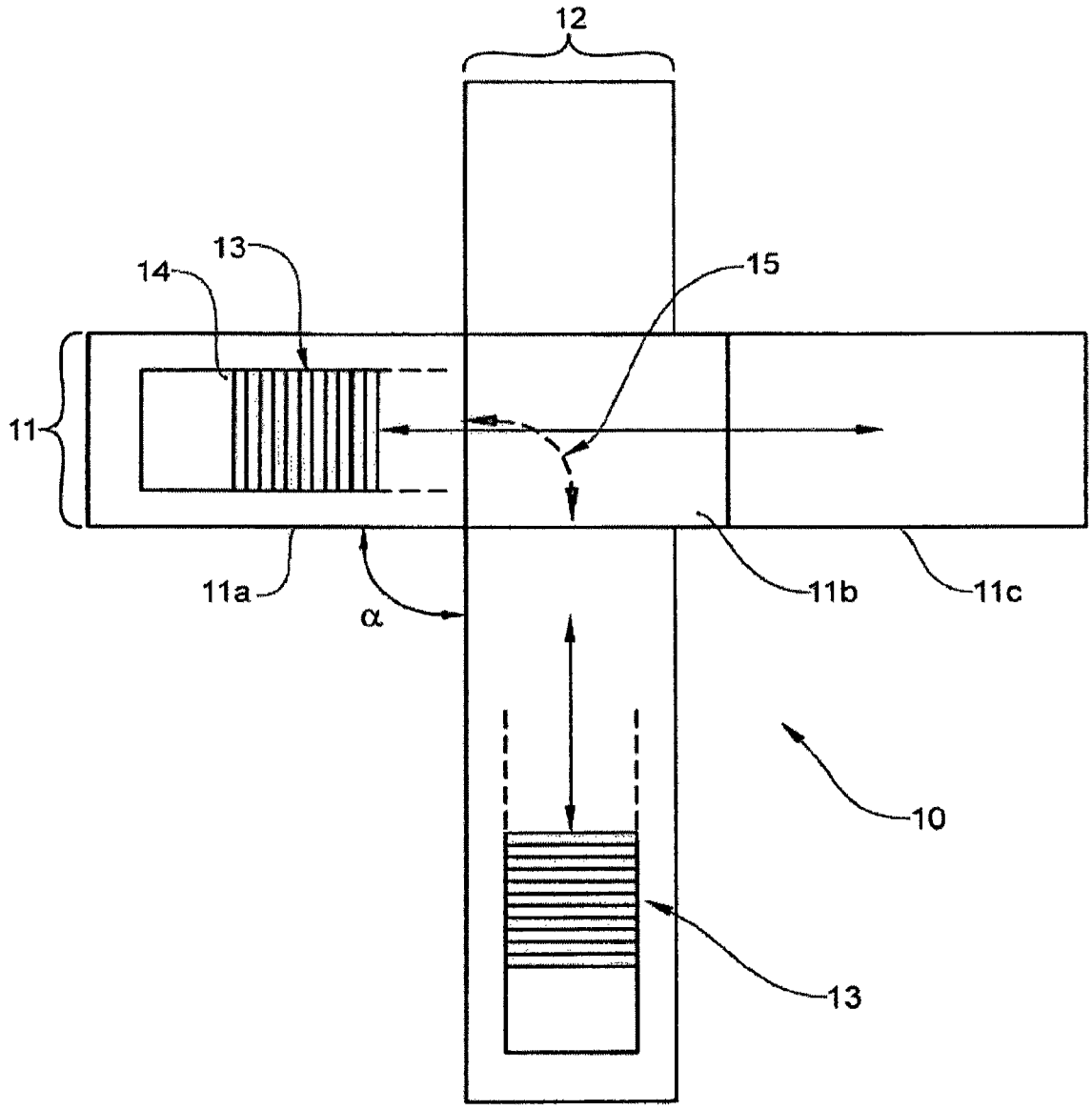
FIG. 1 shows in top view from above the layout of a crossing according to an illustrative embodiment of the invention, wherein the diversion is indicated by a dashed double arrow.

In FIG. 1, the (heavily simplified) layout of a crossing according to an illustrative embodiment of the invention is represented in top view from above. The crossing 10 consists in this case of two transport lines 11 and 12, which intersect at a right angle of $\alpha$=90° and on which the planar articles 14, here in the form of an imbricated stream 13, can be transported in the longitudinal direction of the line. In principle, the transport on the transport lines 11, 12 can be realized in both directions. In the present example, the transport line 12 is configured as a solid continuous line, whilst the transport line 11 which leads away over it at a distance apart comprises a plurality of line portions 11*a-c*. As becomes clear from FIG. 2, the middle line portion 11*b* is configured as a swing-out portion.

Between the lower transport line 12 and the intersecting transport line 11 lying above it at a distance apart d is arranged a transfer apparatus 15, which in FIG. 1 is indicated merely by a dashed double arrow, yet in the side view of FIG. 2 can be seen in schematic representation. The transfer apparatus 15 comprises a diversion line 25, which tracks an intrinsically distorted space curve, so that the articles 14 transported on the diversion line 25 are diverted by 90° in the plane of the intersecting transport lines 11, 12 and, at the same time, turned. In addition, the articles 14 are raised or lowered in height by the distance d, depending on the transport direction. An intrinsically distorted space curve of this kind has the particular advantage of being adaptable.

This adaptability of the diversion line 25 is of particular importance for the present invention, since it enables a particularly simple design of the switchable transfer apparatus 15. This can be illustrated in a simple manner with reference to FIG. 2: According to FIG. 2*a*, the diversion line 25 of the transfer apparatus 15 is arranged in such a way beneath the middle line portion 11*b* of the above-situated transport line 11 that, when the curved diversion line 25 is stretched (transition from FIG. 2*a* to FIG. 2*b*), the diversion line 25 presses with its free end or head 16, via an actuating means 17, from below against the pivotable or hinged middle line portion 11*b* and swings it out upwards (FIG. 2*b*). At the same time, the diversion line 25 connects with the head 16 to the line portion 11*a*, such that articles 14 which are advanced on this line portion can be transferred directly to diversion line 25, or (in the case of the reverse transport direction) articles 14 led up via the diversion line 25 can be forwarded directly to the line portion 11*a*. The swing-out of the middle line portion 11*b* can be realized—as described above—passively. It is also conceivable, however, to provide a dedicated drive mechanism for the swing-out.

Figure 2A:
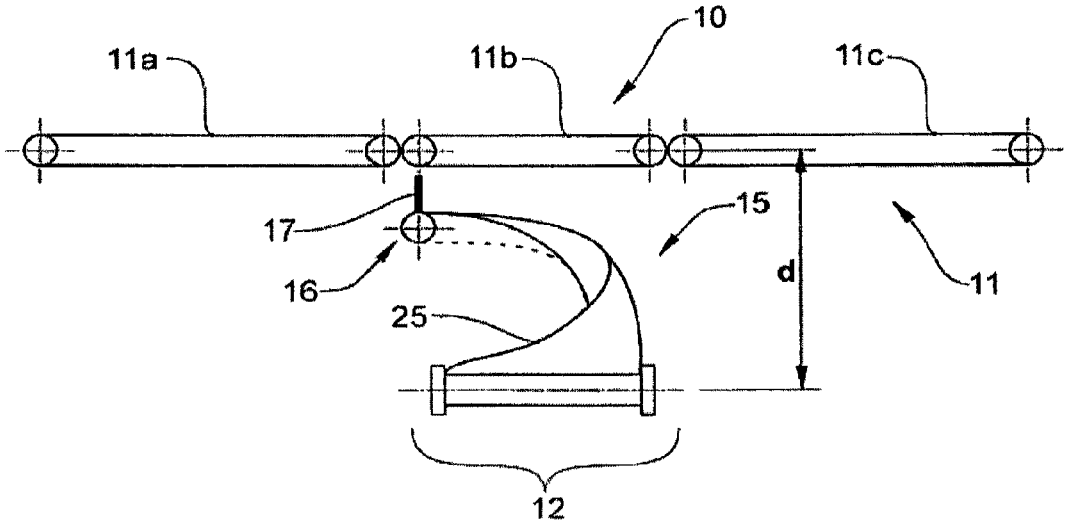
FIG. 2 shows in two sub-FIGS. 2(*a*) and 2(*b*) the crossing from FIG. 1 with disconnected diversion (a) and with connected diversion (b)
Figure 2B:
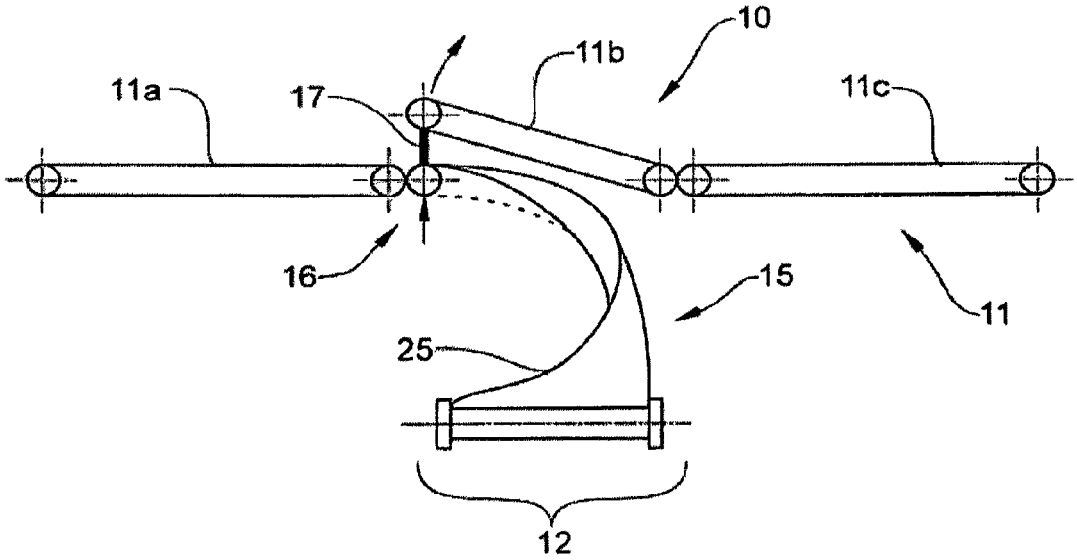

If the engagement of the transfer apparatus 15 in the transport line 11 is to be terminated, the head 16 is relowered, whereby the middle line portion 11*b* falls back into the non-swung-out position of FIG. 2*a* and recloses and opens up the transport line 11. In this switching operation, the other end of the transfer apparatus 15 or diversion line 25 remains fixedly connected to the transport line 12. In principle, however, it is conceivable for the transfer apparatus 15.*to* be configured on this side also such that it can be switched over analogously. Furthermore, in preferred embodiments it is provided (see also FIG. 3) to configure the transfer apparatus 15 such that it is displaceable along the transport line 12 in order with the same transfer apparatus 15 to reach other crossings of the transport line 12 or more than one crossing with transport lines running transversely across it for the purpose of diversion. However, it is also conceivable to provide on the transport line 12 two oppositely diverting transfer apparatuses of the described type, which are selectively driven under the crossing 10 in order to divert an imbricated stream 13 arriving on the transport line 11 to the left or right onto the transport line 12.

Figure 3:
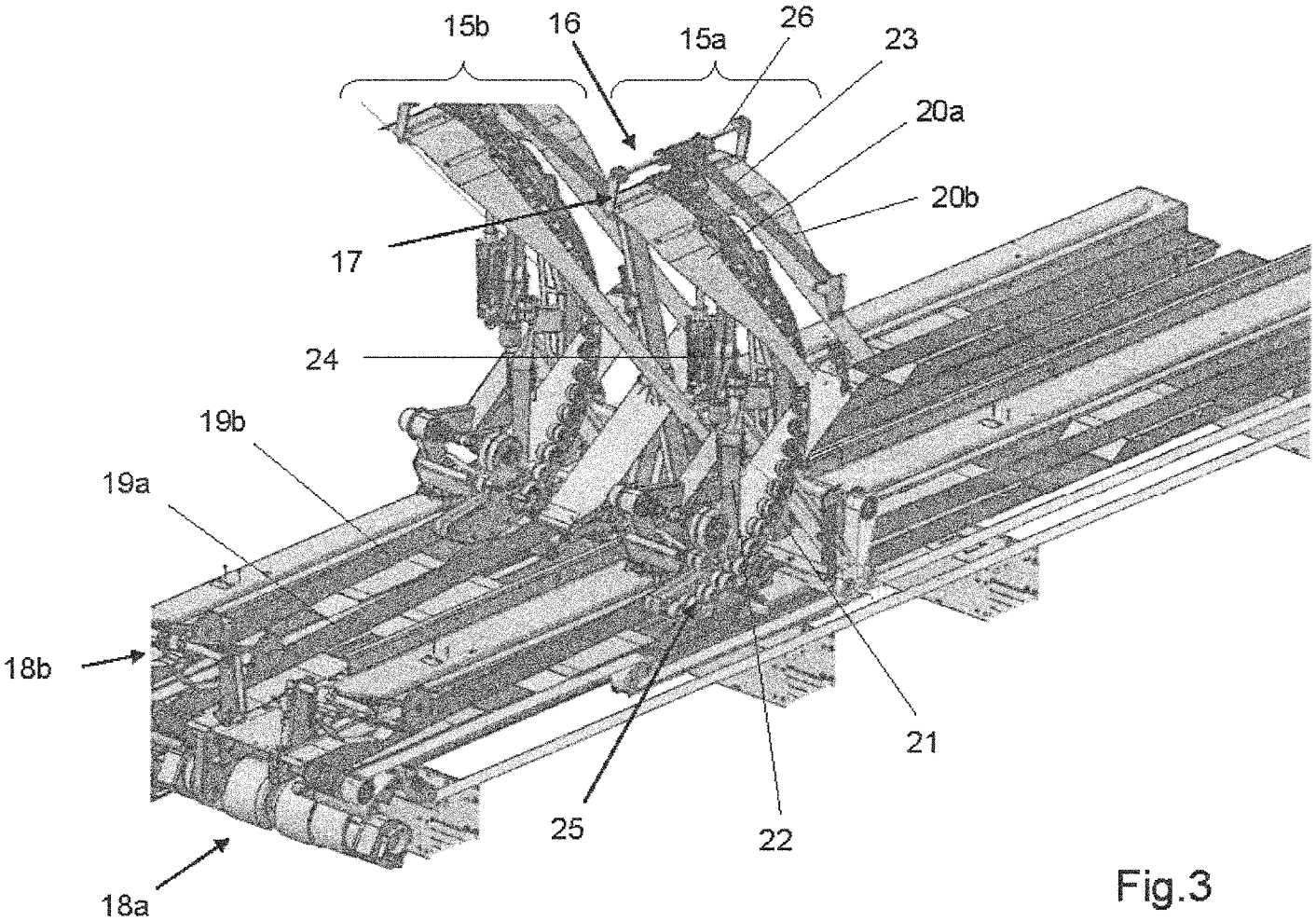
FIG. 3 shows in a perspective side view an illustrative embodiment for a dual transfer apparatus, as is used in a (double) crossing according to FIG. 2.

In FIG. 3, two parallel-working transfer apparatuses 15*a* and 15*b* are arranged next to each other, which transfer apparatuses are respectively displaceable on an associated transport line 18*a* and 18*b*. On the transport lines 18*a,b* are provided conveyor belts 19*a,b*, which circulate in the longitudinal direction of the line and with which the transport of the articles 14 from and to the transfer apparatuses 15*a,b* is realized.

In the transfer apparatuses 15*a,b* is respectively arranged a roller conveyor 21 having rollers which are placed one behind the other along a predefined space curve. Over the rollers of the roller conveyor runs a motor-driven lower belt 22, on which the articles rest in imbricated stream formation. From above, an upper belt 23 nestles in the space curve against the lower belt 22, so that the imbricated stream of the articles is held and transported between the two belts 22 and 23. The upper belt 23 is here not itself driven, but run along by frictional engagement.

On both sides of the roller conveyor 21 are arranged wide supporting strips 20*a, b*, which run parallel to the roller conveyor 21 through the predefined space curve. The supporting strips 20*a,b* can be configured as plastics strips, yet preferably consist of a bendable steel plate. This has the benefit, inter alia, that electrostatic charges are largely avoided. The shape of the space curve of the diversion line 25 is here materially jointly determined by the deformation behaviour of the supporting strips 20*a,b*. As the name says, the supporting strips 20*a,b* support the planar articles held between the belts 22 and 23.

On the head 16 of the transfer apparatuses 15*a,b*, which head, upon switchover, is moved in the vertical direction, is arranged an actuating means 17, which comprises an axle 26 mounted in an upwardly protruding frame. The upper belt 23 is guided divertingly about this axle 26 and forms together with the lower belt 22 an inlet for the articles which are to be accepted.

Figure 4:
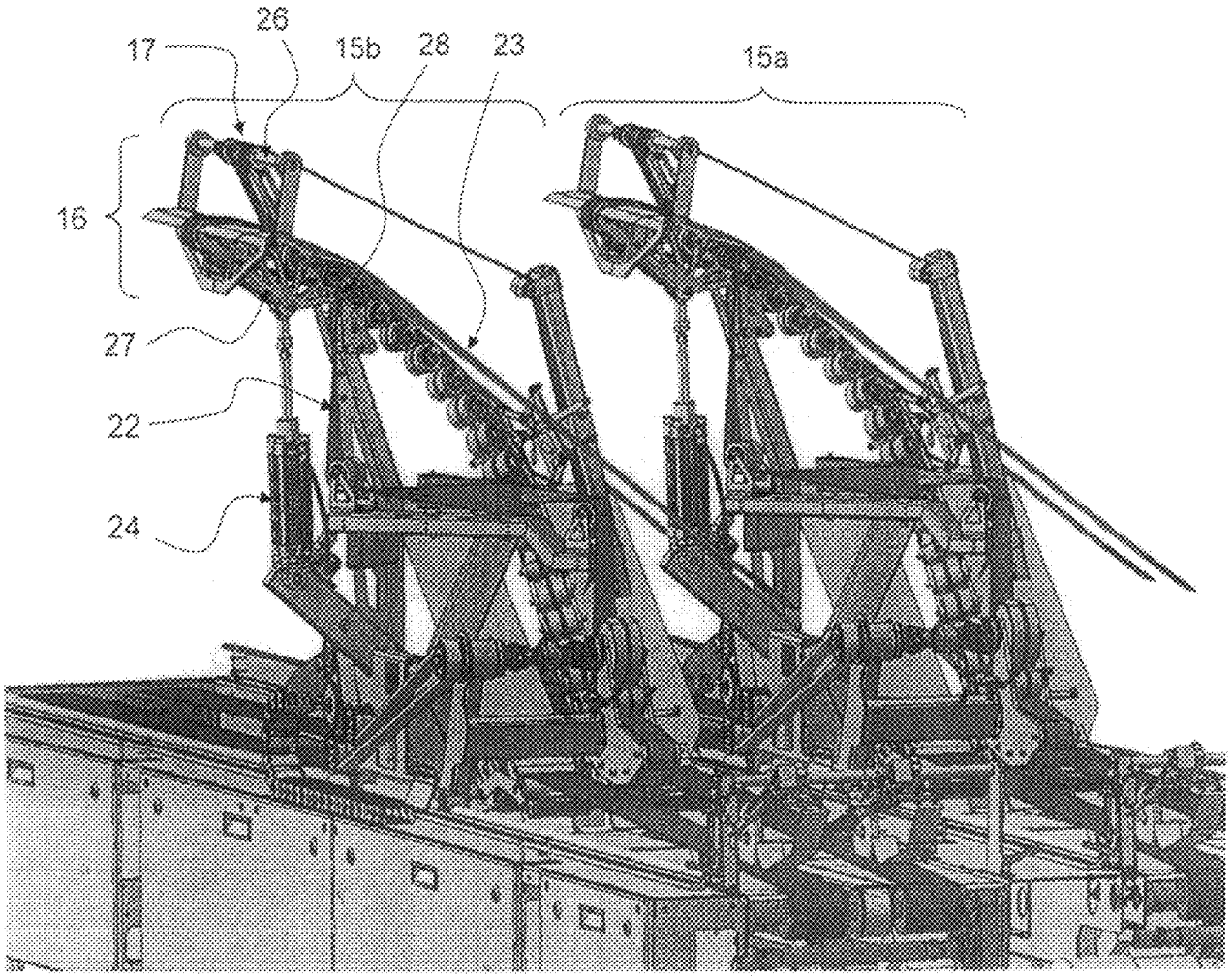
FIG. 4 shows the illustrative embodiment from FIG. 3 in another perspective side view.

The head 16 with the actuating means 17 can be moved vertically by a hydraulically or pneumatically (or even electrically) operated adjusting apparatus 24 (operating cylinder), so that the actuating means 17 engages with or disengages from the middle line portion 11*b*. As can be seen in FIG. 4, the roller conveyor 21 has in the region of the head 16 a pivotable portion 27, which, by means of the adjusting apparatus 24, can be pivoted upwards or downwards about a pivot axis 28 and hereupon moves the actuating means 17.

When the portion 27 or the actuating means 17 is pivoted, the supporting strips 20*a,b* are geometrically deformed. By virtue of their elastic bendability, these can compensate the difference in height through which the head 16 passes in the lower and upper position. It is a particular advantage that, given point suspension of the supporting strips 20*a,b*, the necessary geometric deformation can be equalized over the whole of the, or in any event over appreciable surface areas of the supporting strips 20*a,b*. Self-evidently, in this operation, the roller conveyor 21 and the belts 22 and 23 are moved jointly in accordance with the height adjustment. Because of their flexibility, their three-dimensional compensation motion can be structurally achieved with known means.

In the embodiments which are shown here, the transport lines 11 and 12 are of flat and rectilinear configuration. In particular applications however, it may also be advantageous to arrange the transport lines, or the line portions 11*a-c* thereof, along spatial curves (for example in a flat curve or with a line which overcomes a plane offset). In such arrangements, the lead-in of the head 16 shall be chosen such that a homogeneous lead-in region is obtained. Of course, the transport line 12 can also, if required, have a plurality of line sections.

In preferred embodiments, furthermore, the lead-in region for the planar articles in the region of the head 16 can be realized, instead of in a hinged line portion, also in a closable opening between the line portions 11*a* and 11*b*. In this case, a gap exists between the ends of the two line portions 11*a,b*, which gap can preferably be bridged by a displaceable or movable intermediate element (not depicted). When the head 16 is raised, the intermediate element can be pushed away, for instance by a suitable lever system. This solution is advantageous when the raising of the line portion 11*b* (cf. FIG. 2) can cause collisions with above-situated components. Here too, the clearance at the lead-in point is realized only by a drive which actuates the head 16.

The diversion line 25, as shown in FIGS. 2*a* and 2*b*, has the aforementioned distorted space curve. Within the scope of the inventive concept, it is possible to construct this space curve in various curve shapes, e.g. in the style of a loop, in order to guide the products from above onto the line portion 11 or away from this.

The products can be transported in a known manner in the form of an imbricated stream, but also in isolation or in multilayered arrangement. Furthermore, the angle which the transport lines 11 and 12 form with one another can be realized, apart from in the shown right angle, also in other arrangements, for instance with a 60° angular position.

If, with the described arrangement, the articles are transported and transferred in the form of imbricated streams, these can also be used, in suitable operation, either to condense the imbricated stream by shortening the distance between successive articles or extend it by lengthening this same distance. Such a change in imbricated stream density is achieved by virtue of the fact that the transport speed of the imbricated stream is chosen differently before and after the transfer between two lines: For stretching of the imbricated stream, the post-transfer transport speed is higher, for compression it is lower. By turning the imbricated stream in the transfer apparatus 15*a,b*, it is here possible to ensure that the foremost article in the imbricated stream always comes to lie at the very bottom.

Typically, the invention makes use of a matrix-like 1:n or a m:n arrangement of the transport lines (i.e. for instance 1 transport line 11 crossed with n transport lines 12, or m transport lines 11 crossed with n transport lines 12).

I claim:

1. A crossing (10) between two transport lines (11, 12) configured for the horizontal transport of planar articles (14), in particular print products, preferably in the form of an imbricated stream (13), of which one transport line (11) is disposed over the other transport line (12) at a predefined vertical distance apart (d) and angle, comprising:

controllable means (15), in the region of the crossing (10), for transferring the transported articles from one of the transport lines (11, 12) to the other of the transport lines (11, 12), which controllable means, in a first setting, freely admit the transport of the articles on one of the transport lines (11, 12) and, in a second setting, divert the transported articles from one of the transport lines (11, 12) to the other; and a transfer apparatus (15) having an adaptable diversion line (25), which describes a space curve that effects an angular diversion of the imbricated stream of planar articles with simultaneous turning over of the planar articles onto the other of the transport lines (11, 12), the transfer apparatus (15) including a displaceable free end (16) that, in the first setting, maintains a distance to one of the transport lines (11, 12) and that, in the second setting, engages with the free end in one of the transport lines (11, 12) to effect a diversion.

2. The crossing according to claim 1, wherein an other end of the diversion line (25), opposite the displaceable free end (16), is transport-connected to the other of the transport lines (11, 12).

3. The crossing according to claim 1, wherein the diversion line (25) has a constant length, and in that, upon movement of the free end (16) of the diversion line (25), the space curve of the diversion line (25) changes.

4. The crossing according to claim 1, wherein the diversion line (25) includes at least one bendable supporting strip (20*a,b*), which tracks the space curve and on which the articles (14) transported on the diversion line (25) are guided in recumbent arrangement.

5. The crossing according to claim 4, wherein the at least one supporting strip (20*a,b*) comprises a sheet-metal strip.

6. The crossing according to claim 4, further comprising:

two mutually parallel running, spaced-apart supporting strips (20*a,b*); and a roller conveyor (21) tracking the space curve arranged between the supporting strips (20*a,b*).

7. The crossing according to claim 6, further comprising:

a driven lower belt (22) resting on the roller conveyor (21), for the transport of the articles (14) along the roller conveyor (21).

8. The crossing according to claim 7, further comprising:

an adjacent upper belt (23), which is passively moved together with the lower belt (22), for the fixing of the articles (14) on the lower belt (22).

9. The crossing according to claim 1, wherein in one of the transport lines (11, 12) is provided a swing-out line portion (11*b*), and in that on the movable free end (16) of the diversion line (25) is arranged an actuating means (17), with which the diversion line (25), upon engagement in one of the transport lines (11, 12), pivots the swing-out line portion (11*b*) out of one of the transport lines (11, 12).

10. The crossing according to claim 9, further comprising:

an adjusting apparatus (24) for the movement of the free end (16) of the diversion line (25).

11. The crossing according to claim 10, wherein the adjusting apparatus (24) works pneumatically or hydraulically or electrically.

12. The crossing according to claim 1, wherein the two transport lines (11, 12) intersect at an angle of substantially 90°, and in that the diversion line (25) describes a space curve, which effects a diversion of substantially 90°, with simultaneous turning of the planar articles.

* * * * *